US009549659B2

(12) United States Patent
Jensen et al.

(10) Patent No.: US 9,549,659 B2
(45) Date of Patent: Jan. 24, 2017

(54) DISH RACK FOR OVERSIZED CONTAINERS

(75) Inventors: Andrew Michael Jensen, St. Paul, MN (US); Wesley Mark Nelson, Grant, MN (US); Bryan John Henneman, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 40 days.

(21) Appl. No.: 13/551,039

(22) Filed: Jul. 17, 2012

(65) Prior Publication Data

US 2014/0021153 A1 Jan. 23, 2014

(51) Int. Cl.
*A47L 15/50* (2006.01)
*A47L 15/00* (2006.01)

(52) U.S. Cl.
CPC ..... *A47L 15/501* (2013.01); *A47L 15/0092* (2013.01); *Y10T 29/49826* (2015.01)

(58) Field of Classification Search
CPC ..... A47L 19/04; A47L 15/50; A47L 15/502; A47L 15/501; A47L 15/0092; A47J 47/16; A47F 7/0064
USPC ..... 211/41.1, 41.2, 41.3, 41.4, 41.8, 41.9, 211/85.25, 133.6, 126.1, 71.01; 206/564, 206/449, 431; 220/487, 488, 676
See application file for complete search history.

(56) References Cited

U.S. PATENT DOCUMENTS 499,951 A * 6/1893 Baird ..... 220/572
1,740,424 A * 12/1929 Blaine ..... 206/449
1,759,993 A * 5/1930 McGill ..... 220/487
1,867,738 A * 7/1932 Fraser ..... 206/449
2,100,720 A * 11/1937 Page ..... 206/449
2,213,918 A 9/1940 Lofstrand, Jr.
3,028,972 A * 4/1962 Guillaumant ..... 211/41.11
3,245,548 A 4/1966 Kesilman et al.
3,252,582 A 5/1966 Kesilman et al.
3,451,557 A * 6/1969 Stoddard ..... 211/41.9
3,465,892 A * 9/1969 Taylor ..... 211/41.11
3,951,265 A * 4/1976 Carroll ..... 206/506
4,106,624 A * 8/1978 Thurman ..... 206/507
4,183,437 A 1/1980 Crawford et al.
4,226,192 A * 10/1980 Myers ..... 108/53.1
4,480,745 A * 11/1984 Loge et al. ..... 211/85.26
4,577,764 A * 3/1986 Silka et al. ..... 211/41.4
5,131,419 A * 7/1992 Roberts ..... 134/50
5,423,437 A * 6/1995 Kayem ..... 211/70.7
5,911,320 A * 6/1999 Forestelle ..... 206/215
5,934,486 A 8/1999 Jarvis et al.
6,012,593 A * 1/2000 Knittel et al. ..... 211/41.11
(Continued)

FOREIGN PATENT DOCUMENTS

DE 10126535 C1 * 11/2002
GB 244278 A * 12/1925

*Primary Examiner* — Stanton L Krycinski
(74) *Attorney, Agent, or Firm* — McKee, Voorhees & Sease, PLC

(57) ABSTRACT

The invention is a dish rack for accommodating oversized containers in an automated dish machine. The rack includes a generally porous base surrounded by upstanding sidewalls and at least a pair of notches in one sidewall or opposing sidewalls configured for receiving an edge of the an oversized container. One form of the invention includes a wire framework having a base and one or more stanchions that extend generally upwardly from the base. The notches and wire framework are configured for supporting an oversized container at an angled position within an automated dish machine to inhibit spray from being directed out of the dish machine.

6 Claims, 9 Drawing Sheets

(56) References Cited

U.S. PATENT DOCUMENTS

| | | | | |
|---|---|---|---|---|
| 6,135,296 | A | 10/2000 | Colgrove | |
| 6,634,510 | B2 | 10/2003 | Larson et al. | |
| 6,726,031 | B2 | 4/2004 | Laupan | |
| 7,281,641 | B2 | 10/2007 | Apps | |
| 7,478,642 | B2 * | 1/2009 | Koch et al. | 134/135 |
| 7,857,146 | B2 * | 12/2010 | Disch | A47L 15/245 211/41.3 |
| 8,127,942 | B2 * | 3/2012 | Meshkinfam | 211/41.3 |
| 2005/0178412 | A1 * | 8/2005 | Koch et al. | 134/135 |
| 2011/0061995 | A1 * | 3/2011 | Huff et al. | 198/463.3 |

* cited by examiner

DISH RACK FOR OVERSIZED CONTAINERS

BACKGROUND OF THE INVENTION

1. Field of the Invention

This invention relates generally to a dish rack for oversized containers, and more particularly to a dish rack for supporting and controlling the position of an oversized container in a dish machine.

2. Description of Prior Art

Washing oversized containers, such as tubs and pans, in a commercial dish machine using a conventional dish rack often requires the container to be placed in a rack at an angle to fit within the machine. Sometimes containers are even angled into a dish machine without a dish rack. In both instances, water from the wash arm is deflected off the angled surfaces of the container out of the dish machine. For example, water must be replaced in instances where water is deflected out of the machine. Furthermore, cold water deflected into the wash section must be heated and the water in the prewash replaced if water is deflected from the prewash to the wash section. Whether in a prewash or wash section of a machine, the water deflected outside the machine or into another section has to be replaced and/or heated, which creates bottlenecks, inefficiencies, inconsistent results, poor throughput, unnecessary rework, increased manual handling, and guesswork by a user/operator. Costly chemistries are also lost when water is deflected out of the machine, and the work environment, such as the surrounding floor, becomes dangerously wet and slippery. In most instances, the machine is not able to be used while displaced water is heated and/or replaced.

The present invention addresses these problems and provides an improved dish rack for washing and sanitizing oversized containers in a dish machine.

In addition, the present invention addresses these problems by providing a dish rack that controls the angle of the oversized container in the dish machine to prevent water from being displaced from the machine.

The present invention also addresses the problems associated with washing more than one oversized container at the same time using a single dish rack.

SUMMARY OF THE INVENTION

In one embodiment, the invention is a dish rack for accommodating oversized containers in an automated dish machine. The rack includes a generally porous base surrounded by upstanding sidewalls and at least a pair of notches in one sidewall or opposing sidewalls configured for receiving an edge of the an oversized container. In a preferred form, the notches are adjacent a corner formed by adjoining sidewalls.

In another embodiment, the invention is a rack system for accommodating oversized containers in an automated dish machine. The rack system includes a rack having a porous base surrounded by upstanding sidewalls and at least a pair of notches in one sidewall or opposing sidewalls of the rack. In a preferred form, a wire framework having a base and one or more stanchions extends generally upwardly from the base. The notches and wire framework are configured for supporting an oversized container at an angled position within an automated dish machine to inhibit spray from being directed out of the dish machine.

In another embodiment, the invention is a method for washing oversized containers in a dish machine. The method includes providing a rack having a porous base surrounded by upstanding sidewalls and a pair of notches in one sidewall or opposing sidewalls of the rack. The steps also include taking an oversized container having a base and sidewalls terminating in a mouth and positioning a lengthwise edge of the mouth of the container in the notches in the rack. The rack carrying the container is inserted into the dish machine notched sidewall first. In a preferred form, the notches are used to angle the base and sidewalls of the container relative to walls of the dish machine to inhibit spray from being deflected out of the dish machine.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings, in which:

DETAILED DESCRIPTION OF THE PREFERRED EMBODIMENTS

Referring to the Figures, there is generally disclosed in FIGS. 1A, 2A, 3A, 3C and 4A an improved dish rack for accommodating oversized containers in an automated dish machine according to exemplary aspects of the present invention. Presently, racks are not configured for running oversized containers through a dish machine or the like. As a result, oversized containers are positioned within the dish machine at angles that allow the container to fit using a traditional rack, or in some instances no rack at all. The improved dish rack of the present invention provides support for oversized containers in a dish machine and controls the angle of the oversized container in the dish machine to prevent water from being displaced from the machine. Furthermore, traditional racks do not accommodate the washing of more than one oversized container in a dish machine at the same time. An improved rack system of the present invention addresses the problems associated with washing multiple oversized containers at the same time using a single dish rack.

Figure 1A:
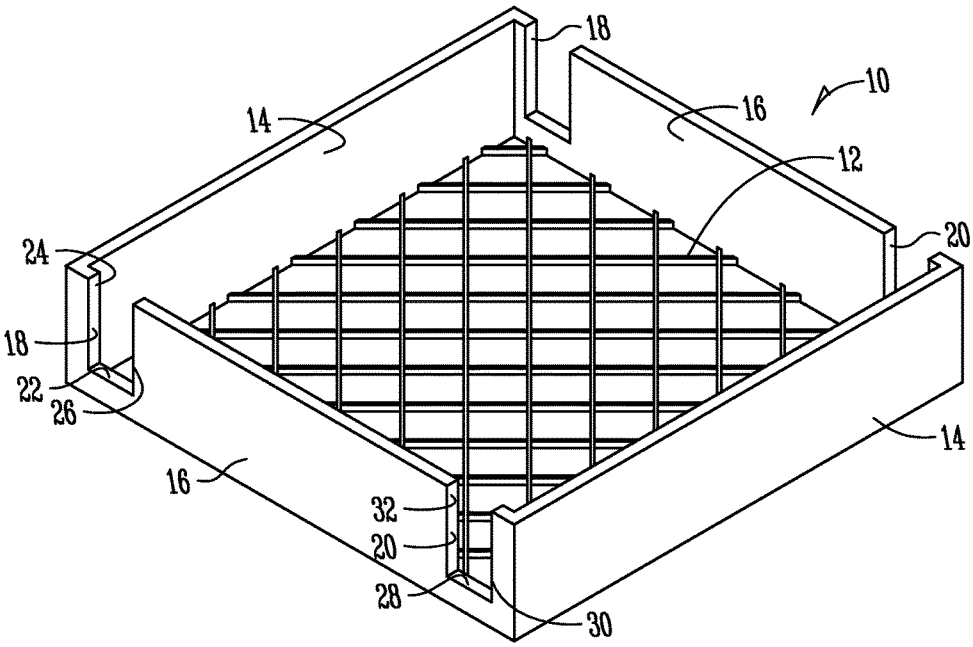
FIG. 1A is a perspective view of a dish rack according to one exemplary aspect of the present invention.
Figure 1B:
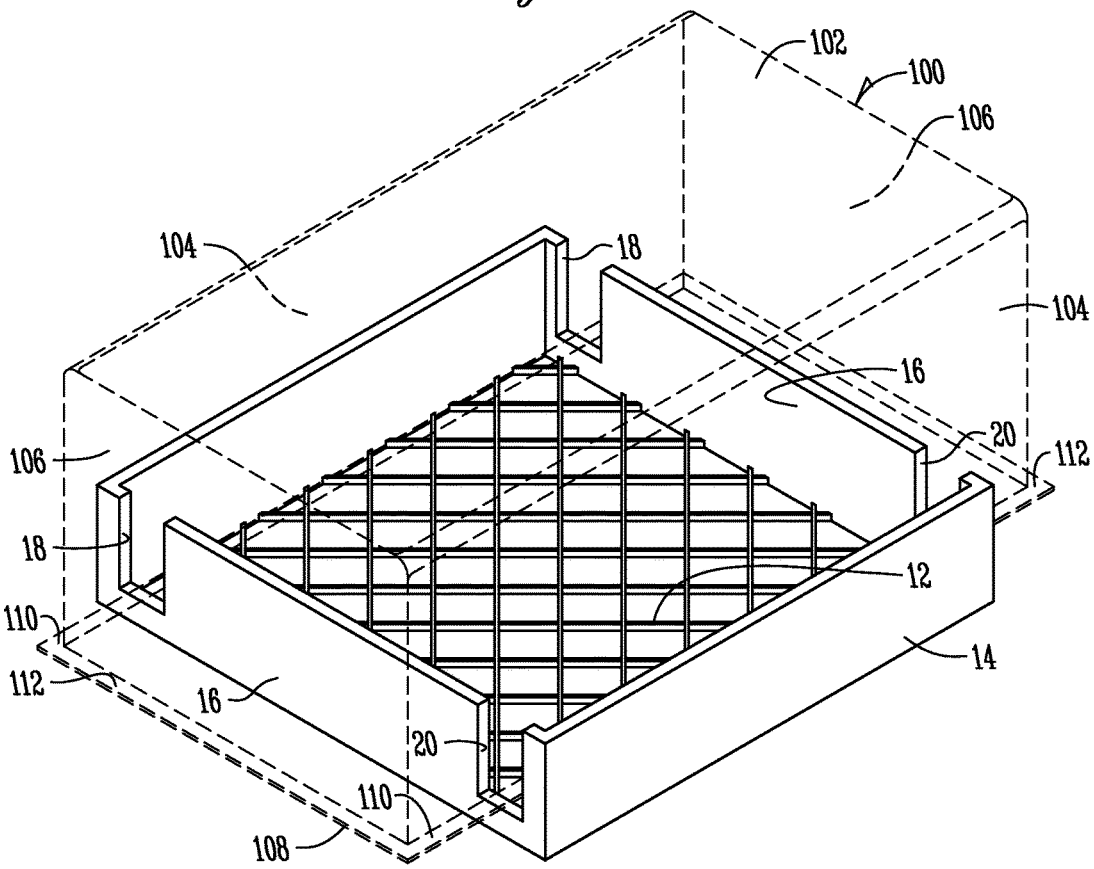
FIG. 1B illustrates an oversized container loaded on the rack shown in FIG. 1A.

FIG. 1 is a perspective view of a dish rack 10 according to an exemplary embodiment of the present invention. The rack 10 includes a base 12 that is generally porous, as derived from its generally open lattice-type construction. As is customary with dish racks, the bottom surface or base 12 is configured to allow water to pass through the base onto the racked items. A pair of opposing sidewalls extend generally vertically upwardly from the base 12. These sidewalls include a first pair of sidewalls 14 and an opposite pair of opposing sidewalls 16. Sidewalls 14 and 16 are connected together at corners to form an upstanding boundary around the base 12. A pair of notches 18 and 20 are configured into opposing sidewalls 16 of the rack 10. The pair of opposing notches 18 and 20 are aligned generally opposite one another in the pair of opposing sidewalls 16. The pair of notches 18 include a generally planar bottom edge 22 and generally vertical outside 24 and inside 26 edges extending upward from the bottom edge 22 terminating at the top of the sidewall. Similarly, notches 20 include a generally horizontal bottom edge 28 with a generally vertical outside edge 30 and inside edge 32 extending upward from the bottom edge 28 and terminating at the top of the sidewall. The present invention contemplates that the bottom edge 22 and 28 of the pair of notches 18 and 20 may be configured to create notches of varying depth, such as where the bottom edge 22 and 28 is generally planar with the base 12 of the rack 10 as shown in FIG. 1A or configured closer to the top edge of the pair of sidewalls 16 as illustrated by notches 18 shown in FIG. 3A. As is further addressed below, the edges of the notches may be reconfigured such as by angling one or more of the edges to control the way an oversized container, such as the container illustrated in FIG. 1B, is received and/or held by the rack 10.

Figure 1C:
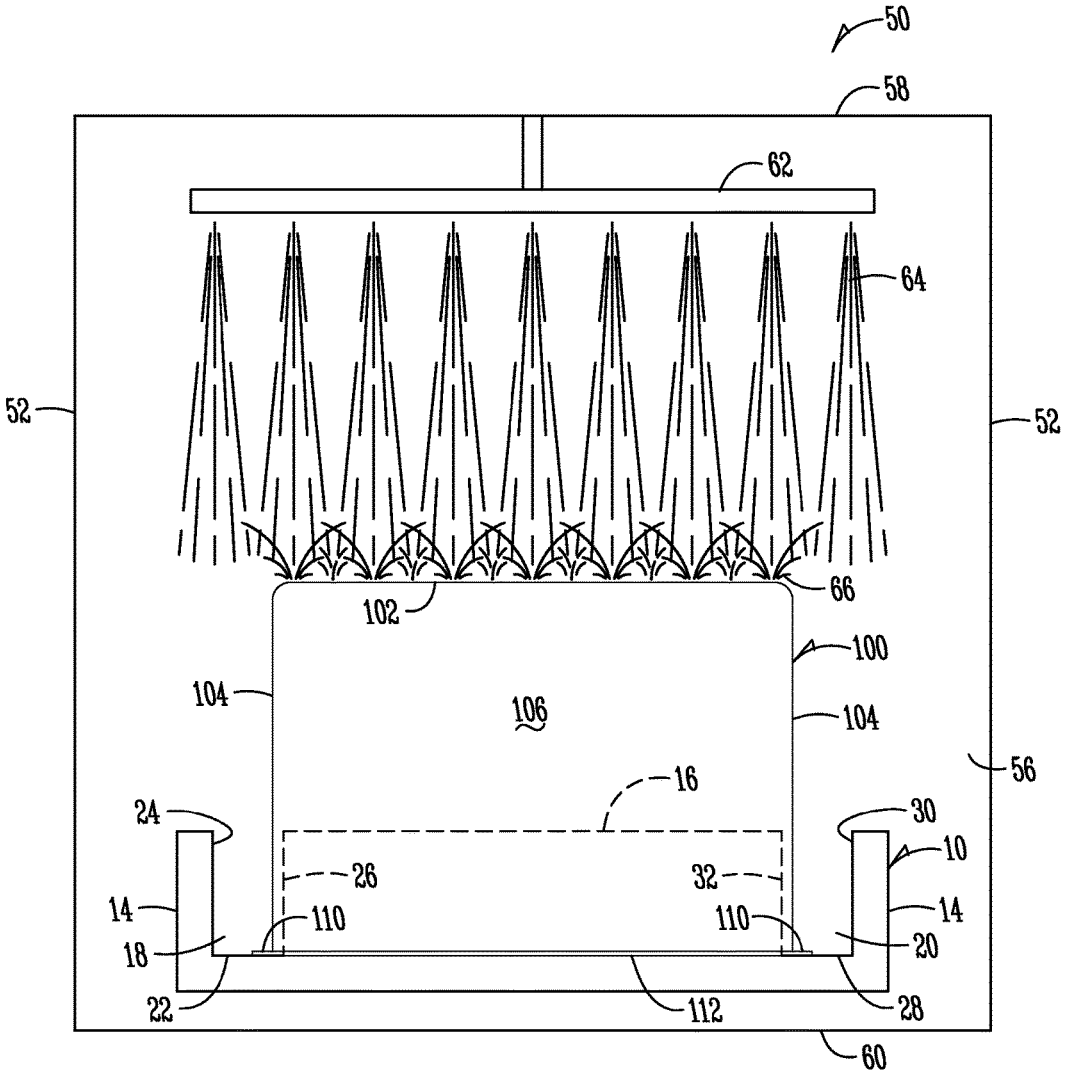
FIG. 1C illustrates the rack and container shown in FIG. 1B in a dish machine.

By way of example, FIG. 1B illustrates and oversized container 100 removably placed upon the rack 10 illustrated in FIG. 1A. The oversized container 100 may be a tub, a pan, or the like, which has a size generally to exceed the base 12 of the rack 10. Thus, the container 100 being described as an oversized container means that the container has a size to exceed the base 12 of the rack 10, or a size that would not fit within the rack 10 but for the notches formed in the opposing sidewalls of the rack 10. As is customary with most containers, such as the container 100 illustrated in FIG. 1B, they include a base 102 with generally upstanding sidewalls 104 and end walls 106 extending therefrom terminating in a mouth 108 formed by sidewall edges 110 and endwall edges 112. The excess length of the mouth 108 of the oversized container 100 is permitted to extend outside the boundary of the sidewalls of the rack. Thus, as illustrated in FIG. 1B, a portion of the sidewall edges 110 and the end wall edge 112 extend outside the boundary of the opposing pair of sidewalls 16. Depending upon the length of the oversized container 100, only one end of the container may extend outside the boundary of the sidewalls while the other end wall edges are contained within the boundary of the sidewalls. Alternatively, the rack 10 may be configured so that one sidewall 16 includes a notch 18 and 20, however, the opposing sidewall 16 does not include notch 18 and 20. Thus, the sidewall with notches 18 and 20 is configured for receiving opposing sidewall edges 110 of an oversized container. In this manner, one end wall edge 112 of the container extends outside the boundary of the sidewalls of the rack 10 while the opposite end wall edge 112 of the container 100 is contained within the boundary of the sidewalls such as adjacent the unnotched opposing sidewall 16. In either configuration, the sidewall edges 110 and end wall edges 112 are permitted to lie generally parallel with the base 12 of the rack 10 thereby controlling the angle of the surfaces of the container (e.g., the base 102, sidewalls 104, and end walls 106) which is critical in controlling the direction at which liquid is deflected off of the surfaces of the container when being washed as illustrated in FIG. 1C.

Given the size of the opening of a standard dish machine 50, the rack 10 is inserted into the dish machine with one of the sidewalls 16 being inserted first (i.e., the rack 10 is inserted notched sidewall first) while the container 100 is positioned on the dish rack 10. The standard depth of the dish machine 50 allows the excess length of the oversized container 100 to fit within the dish machine while racked in the dish rack 10. As best illustrated in FIG. 1C, the commercial dish machine includes sidewalls 52 connecting a top wall 58 to a bottom wall 60. The dish machine 50 includes one or more openings, such as opening 56, through which the rack and oversized container are inserted and/or removed. In addition to these customary features, the dish machine 50 includes a spray arm 62 through which liquid spray 64 exits. The spray 64 impinges on the surfaces of the oversized container 100, and by controlling the orientation of the surfaces of the oversized container 100 while positioned on the rack 10, the deflected spray 66 is directed toward various locations within the dish machine 50 except for toward the openings or opening 56. In this manner, by controlling the orientation or angle of the surfaces of the oversized container by the manner in which the container is positioned relative to the rack 10, deflected spray 66 from the dish machine 50 is kept within the dish machine 50 and from being directed out of the dish machine 50 as might otherwise occur if the surfaces of the oversized container 100 are angled toward the opening when attempting to fit the oversized container 100 within the dish machine 50 using a traditional style dish rack. Similarly, although not shown, a spray arm could be mounted in the bottom portion of the dish machine 50 for directing spray generally vertically upward toward the rack 10 and oversized container 100. In this case, similar to spray 64 from the spray arm 62, liquid from a lower spray arm would be deflected off of the surfaces of the oversized container 100 toward various locations within the dish machine 50 except for the openings or opening 56. For example, the base of the oversized container 100 is oriented generally horizontally and the sidewalls 104 and end walls 106 generally vertically in the dish machine 50 so that spray 64 impinging on the surfaces of the container 100 is deflected in a direction other than toward the openings or opening 56 of the dish machine 50. Other embodiments of the dish rack 10, as further addressed below, illustrate that the oversized container 100 can be positioned at specific angles on the rack 10 and placed within the dish machine 50 and still inhibit spray from being deflected toward the openings or opening 56 of the dish machine 50.

Figure 2A:
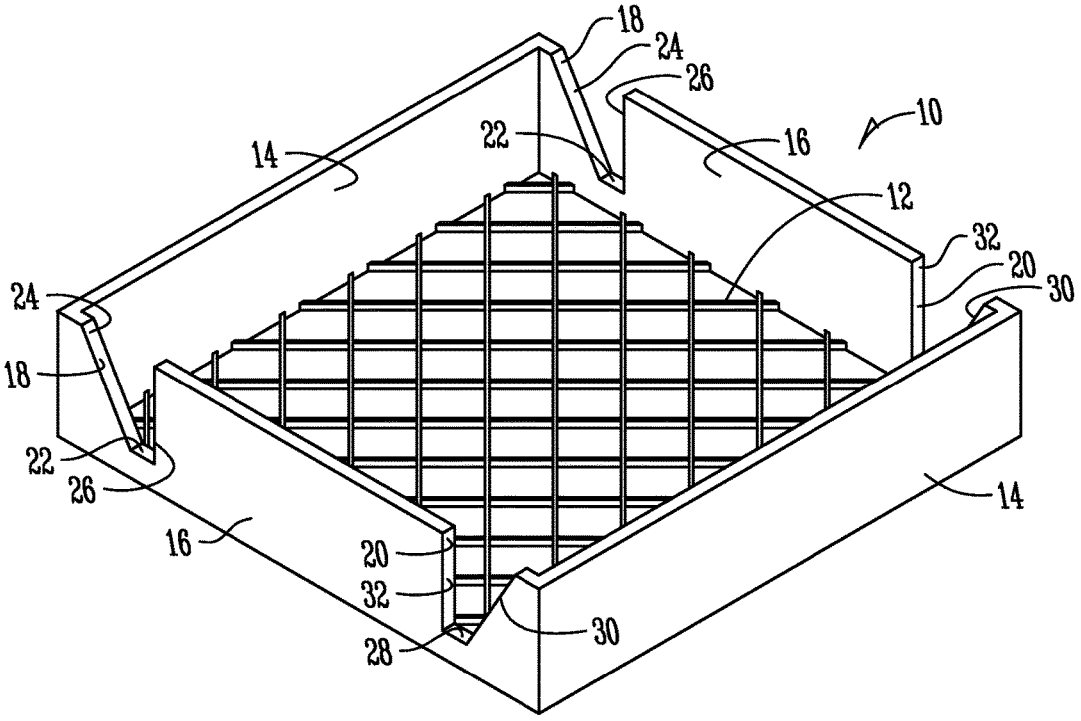
FIG. 2A is a perspective view of a dish rack according to another exemplary aspect of the present invention.
Figure 2B:
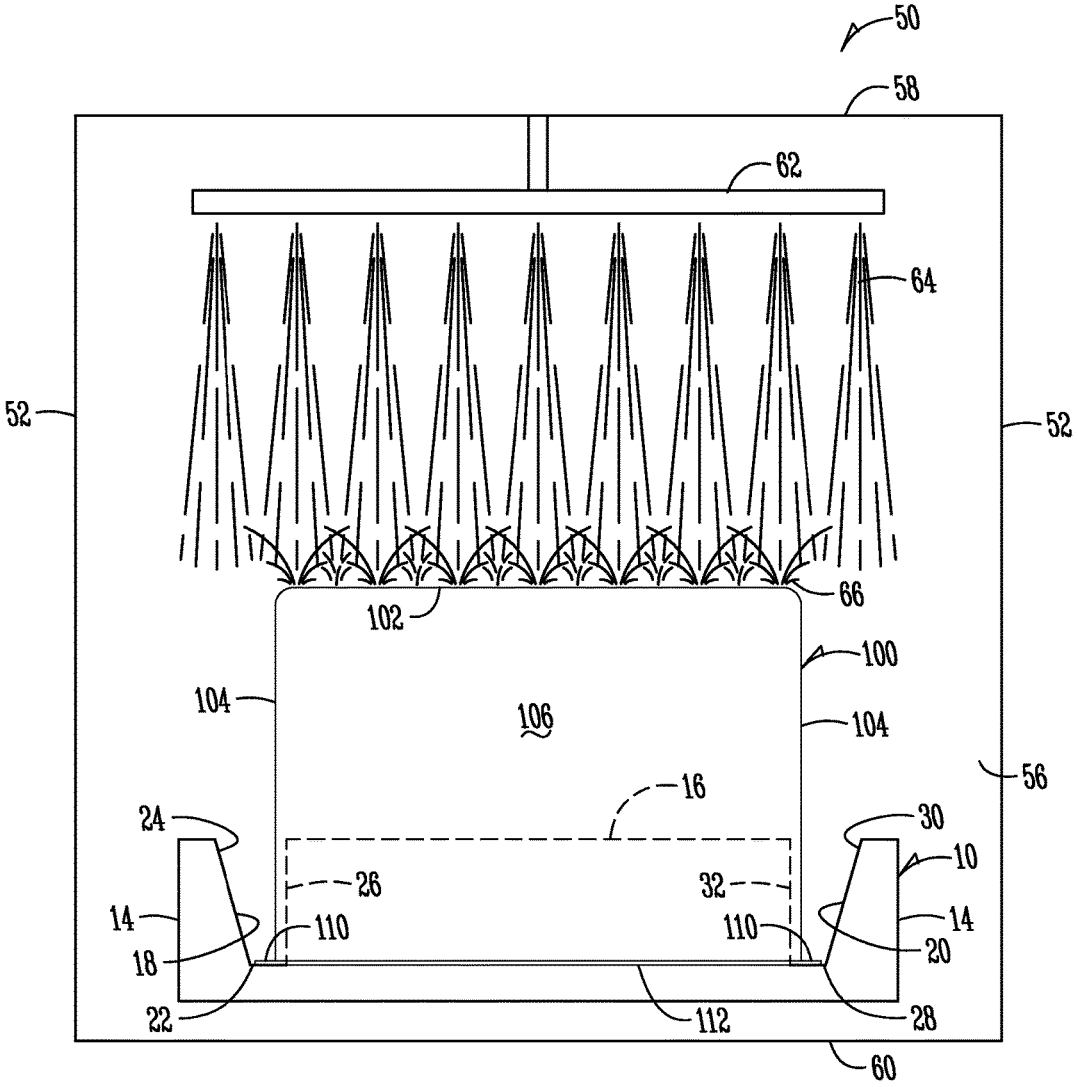
FIG. 2B illustrates the rack and container shown in FIG. 2A in a dish machine.

FIG. 2A illustrates another exemplary embodiment of the dish rack 10 of the present invention. Similar to rack 10 illustrated in FIGS. 1A-1C, the rack 10 illustrated in FIG. 2A includes a base 12 with upstanding sidewalls 14 and 16. The notches 18 and 20 in the opposing sidewalls 16 include respective bottom edges 22 and 28 with outside edges 24 and 30 and inside edges 26 and 32 extending upward toward the top edge of the sidewall 16. As illustrated, the outside edges 24 and 30 are angled away from vertical toward respective opposing corners of the rack 10. Alternatively, the inside edges 26 and 32 may be angled away from vertical and the outside edges 24 and 30 configured generally vertically. As illustrated in FIG. 2B, the sidewall edges 110 of the oversized container 100 are received within the notches 18 and 20 in opposing sidewalls 16 of the rack 10. The length of the bottom edge 22 and 28 along with the angle of the taper of the outside edge 24 and 30 may be configured to pinch the sidewall edges 110 of the oversized container 100 when placed on the rack 10 to prevent movement of the oversized container 100 relative to the rack 10. Depending upon the width of the sidewall edges 110 of the oversized container 100, these edges may not lie flush on the bottom edges 22 and 28 of respective notches 18 and 20. For example, if the sidewall edges 110 of the oversized container 100 are wider than the width of the bottom edges 22 and 28 of the notches 18 and 20, the tapered notch allows the sidewall edges 110 to be received within the notches and pinched or secured between the respective outside edges and inside edges of both notches to prevent movement of the oversized container 100 relative to the rack 10. In this manner, an oversized container having various sized sidewall edge widths can be received within the notches 18 and 20 in the rack 10. The tapering of one of the edges of the notches 18 and 20 allows the oversized container 100 to be removably secured to the rack 10, to inhibit movement, while being transferred to and from and while within the dish machine 50 as illustrated in FIG. 2B. The tapered edges of the notches 18 and 20 permit oversized containers with various widths for the sidewall edges 110 to still be racked so that the base 102 of the oversized container 100 is generally horizontal to control the direction in which spray 64 from the spray arm 62 is deflected, and particularly inhibits deflected spray 66 away from an opening, such as opening 56, of the dish machine 50. In this manner, an oversized container 100 having various widths sidewall edges may be received within the notches of the rack 10 in an orientation to prevent spray from being deflected out of the dish machine 50 while securing the position of the oversized container 100 relative to the rack 10 by pinching the sidewall edges of the container within the notches of the rack. Furthermore, use of the tapered notches to removably secure the oversized container 100 to the rack 10 also helps prevent the container 100 from moving within the dish machine 50 from the force of the liquid being sprayed from an upper and/or lower spray arm.

Figure 3A:
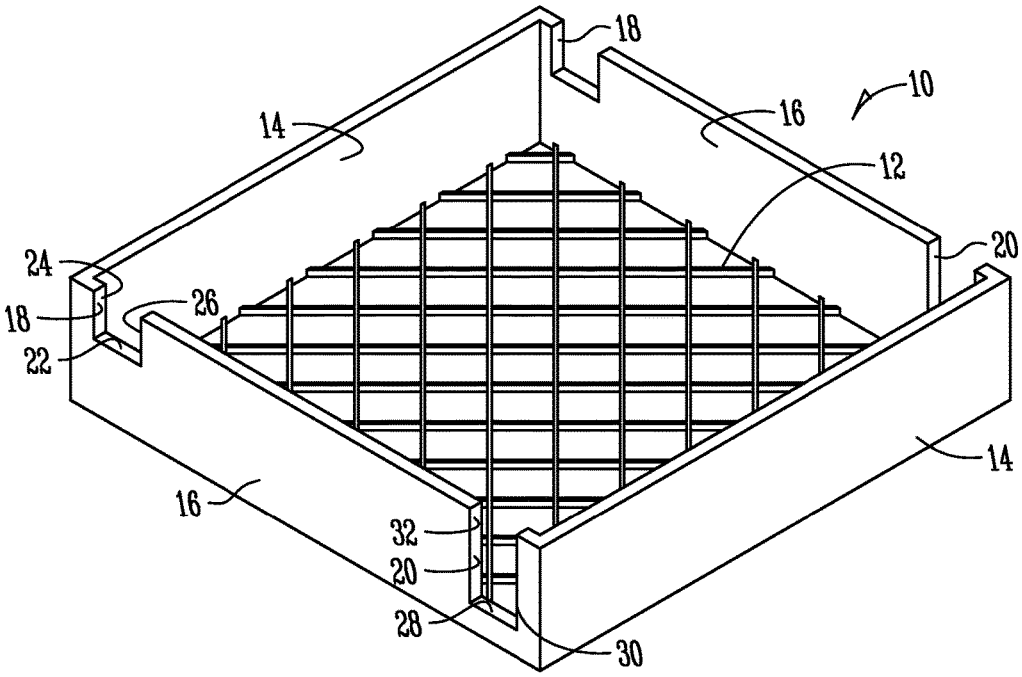
FIG. 3A is a perspective view of a dish rack according to another exemplary aspect of the present invention.
Figure 3B:
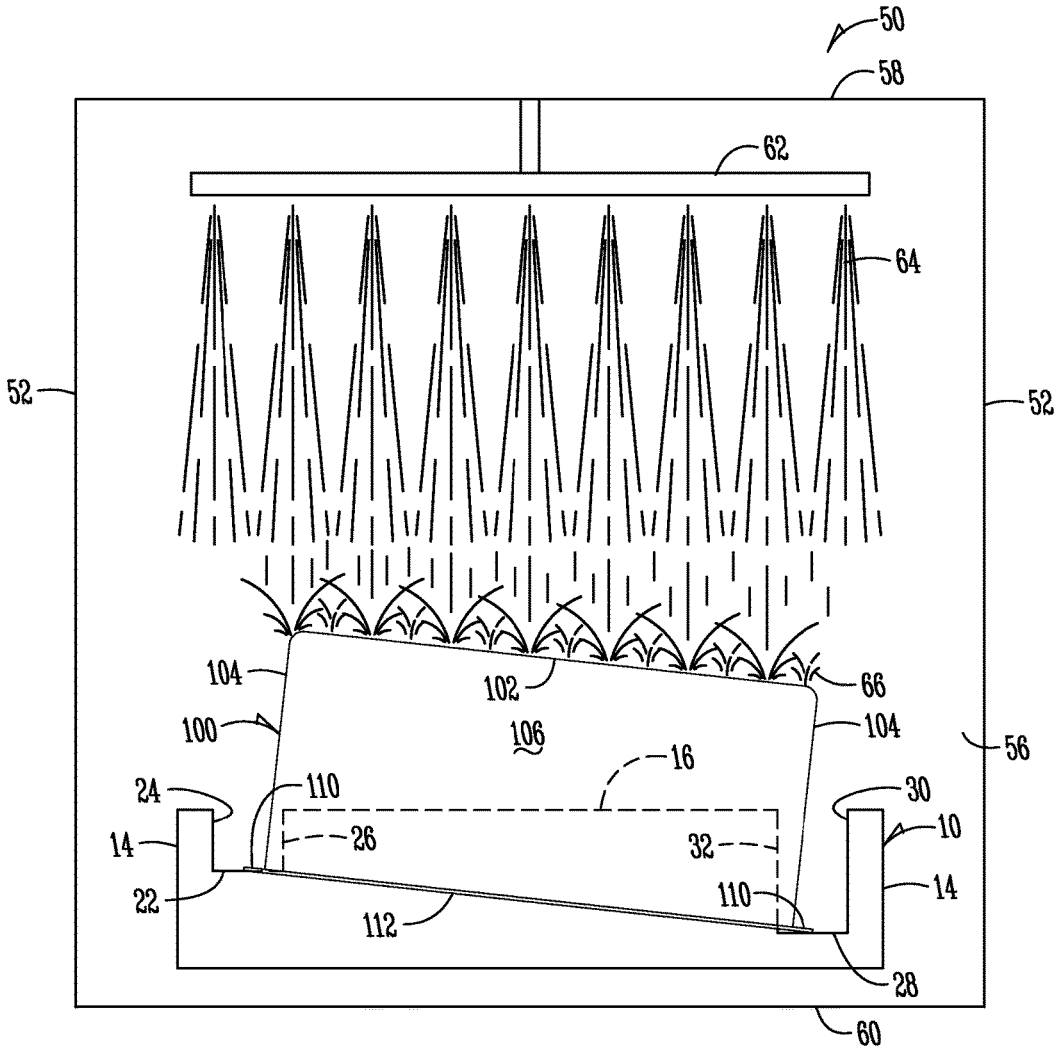
FIG. 3B illustrates the rack and container shown in FIG. 3A in a dish machine.

FIGS. 3A-B illustrate another exemplary embodiment of a dish rack 10 of the present invention. Similar to the previous racks illustrated and addressed above, rack 10 includes a base 12 with generally upstanding sidewalls 14 and 16 providing a vertically oriented boundary about the base 12. Opposing sidewalls 16 include notches 18 and 20. Notches 20 have a depth to exceed the depth of notches 18 so that when the oversized container 100 is placed on the rack 10 as illustrated in FIG. 3B, the base 102 of the oversized container 100 is angled toward one of the sidewalls 14, and angled toward one of the sidewalls 52 when placed within the dish machine 50. As illustrated in FIG. 3B, varying the depth of notches 18 and 20 allows the oversized container 100 to be angled relative to the rack 10 and the impinging spray from the spray arm 62. Angling the oversized container 100 toward one of the sidewalls 14 directs the deflected spray 66 from the spray arm 62 toward a sidewall 52 of the dish machine 50 instead of one of the openings such as opening 56 through which the rack 10 with the oversized container 100 is inserted and/or removed from the dish machine 50. Having notches 18 and 20 at differing depths also allows the oversized container 100 to be racked at an orientation whereby spray 64 from the spray arm 62 impinging upon surfaces of the oversized container 100 is directed toward various locations within the dish machine 50 except for the openings of the dish machine 50. Specifically, angling the container toward one of the sidewalls 52 of the dish machine 50 deflects the spray toward the sidewalls and not the opening or openings of the dish machine 50. The angle of the oversized container 100 also encourages liquid that might otherwise bead-up and accumulate on flat surfaces of the container 100 to run off for purposes of maintaining liquid within the dish machine 50 and promoting a dryer finished product. Additionally, altering the depths of the notches 18 and 20 of the rack 10 allows the rack 10 to hold wider containers while still maintaining the orientation of the container 100 so as to prevent or inhibit spray from being deflected toward an opening or openings of the dish machine 50.

Figure 3C:
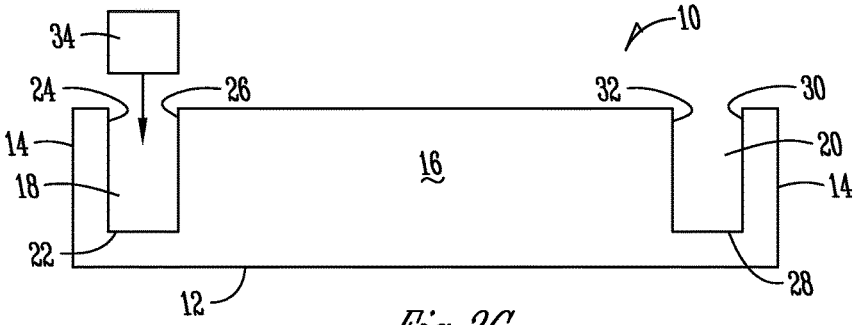
FIG. 3C is a front elevation view of another dish rack embodiment of the invention.

FIG. 3C illustrates another exemplary embodiment of the dish rack 10 illustrated in FIG. 3A-B. Specifically, an insert 34 may be inserted into a pair of the notches such as the opposing notches 18 in sidewall 16 to change the angle at which the oversized container 100 rests on the rack 10 as well as providing an option for the rack 10 to accept oversized containers of varying width, specifically oversized containers having larger widths. The size of the inserts 34 may be adjusted to control the depth of a pair of opposing notches such as the depth of notches 18 relative to the depth of notches 20 thereby controlling the angle of the oversized container 100 when racked. The inserts 34 provide a user with the flexibility to adjust the rack 10 to accommodate varying widths of oversized containers and also control the angle at which the oversized container 100 is racked relative to impinging spray 64 from spray arm 62 when placed within a dish machine 50 such as the one illustrated in FIG. 2B.

Figure 4A:
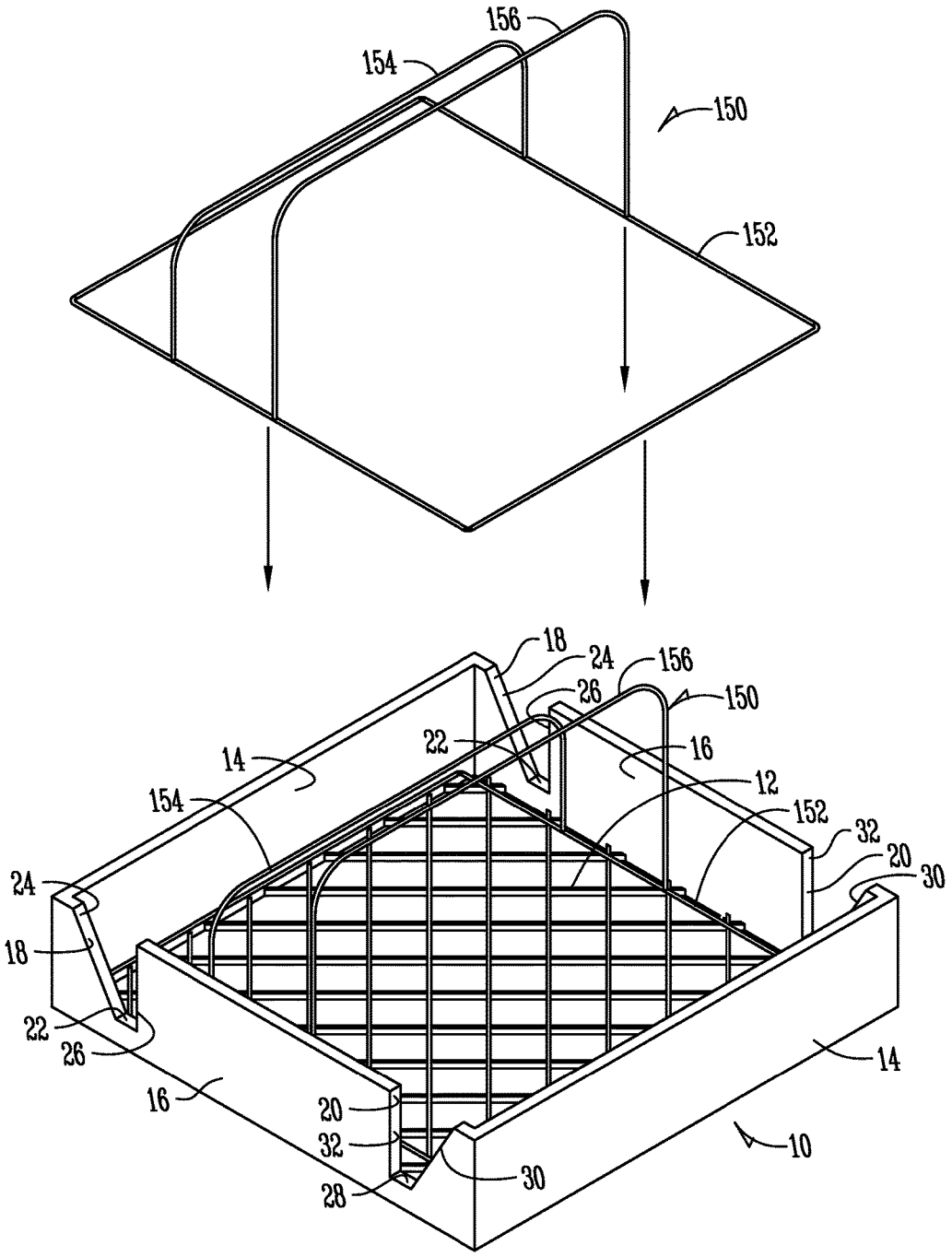
FIG. 4A is a perspective view of a dish rack carrying a wire frame according to an exemplary embodiment of the invention.
Figure 4B:
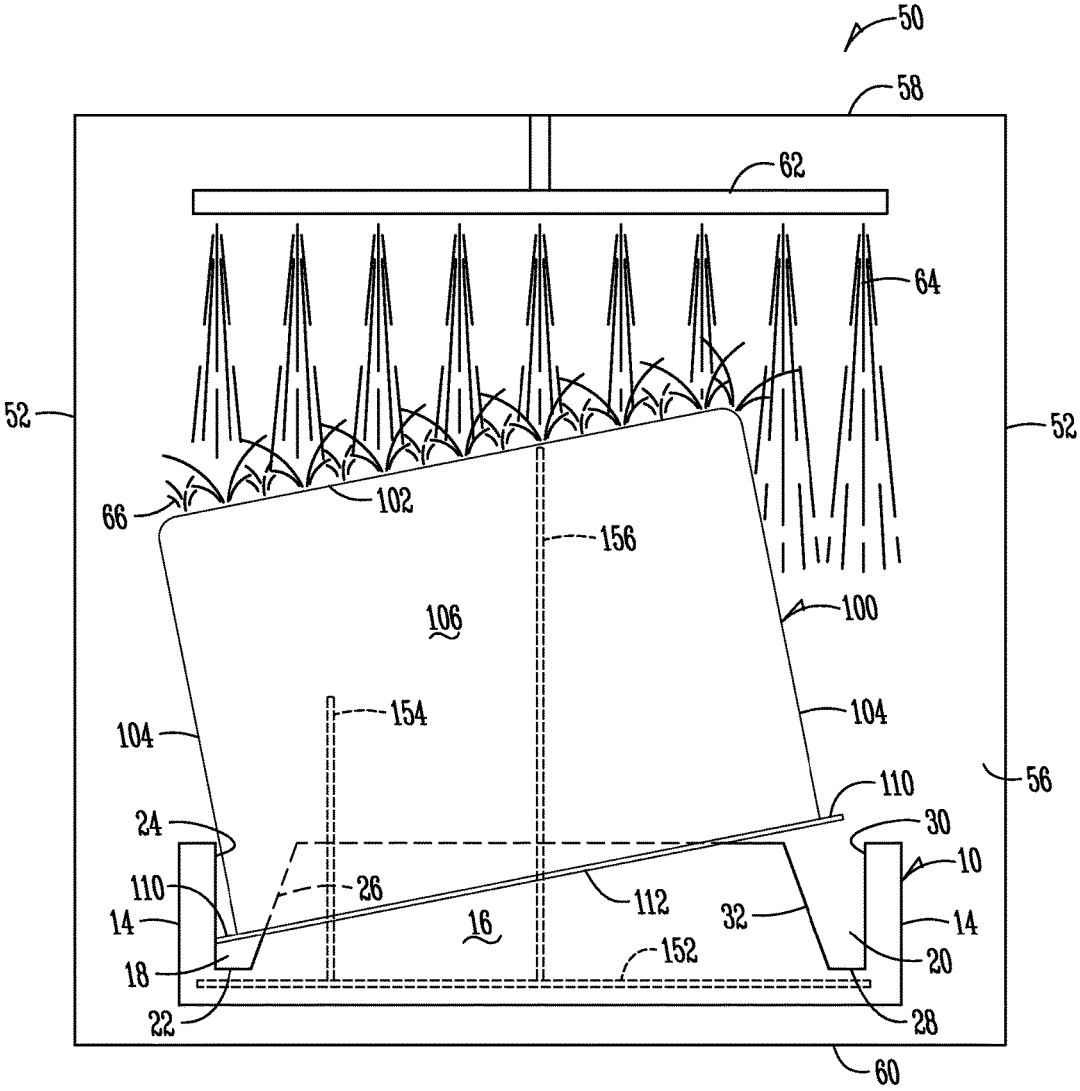
FIG. 4B illustrates the rack and wire frame shown in FIG. 4A supporting an oversized container within a dish machine.
Figure 4C:
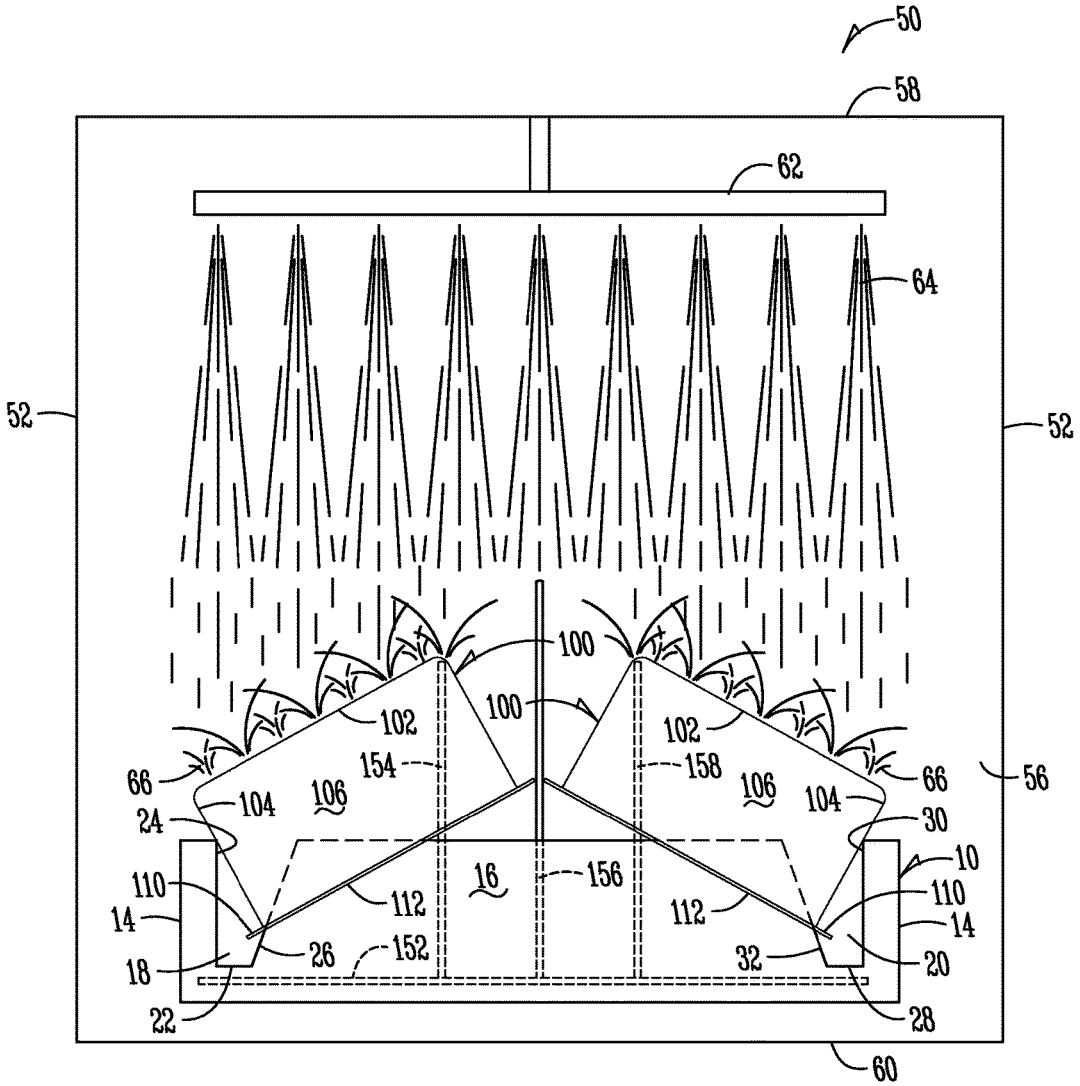
FIG. 4C illustrates the rack and wire frame shown in FIG. 4A supporting more than one oversized container within a dish machine.

FIGS. 4A-C illustrate another exemplary embodiment of a dish rack 10 of the present invention. Similar to the dish rack 10 illustrated in FIGS. 2A-B, the dish rack 10 in FIG. 4A includes a base 12 with upstanding sidewalls 14 and 16 forming a boundary about a vertically upstanding boundary about the base 12. Opposing notches 18 and 20 in opposing sidewalls 16 of the rack 10 include tapered outside edges 24 and 30. A wire frame 150 having a base 152 and one or more upstanding stanchions, such as stanchion 154 and 156, is removably insertable into the base 12 of the rack 10. The stanchions 154 and 156 may be rigidly attached to the base 152 or attached in a manner such that the stanchions may be angled relative to the base 152. As illustrated, the base 152 and stanchions 154 and 156 are wire forms but could be formed from other materials, such as materials suitable for use within a dish machine 50 or customarily used for dish racks. As best illustrated in FIG. 4B, the oversized container 100 is placed on the rack with one of the sidewall edges 110 resting within a pair of notches, such as notches 18 in opposing sidewalls 16. The oversized container 100 is supported at an angled position relative to the rack 10 by stanchion 156. The stanchion 156 supports the oversized container 100 on the inside of the base 102 of the container 100 at an angle whereby one of the sidewall edges 110 is elevated above the opposing sidewall edge 110 of the container 100. The wire frame 150 allows oversized containers of various size, depth and width to be racked at an angle on rack 10 so that spray 64 from spray arm 62 is deflected toward the sidewalls 52 of the dish machine 50 and not toward one of the openings, such as opening 56, through which the rack 10 and container 100 may be inserted and/or removed. Since the stanchions 156 and 154 angle surfaces of the container 100 toward the sidewalls 52 of the dish machine 50 and not toward the openings of the dish machine 50, the deflected spray 66 is directed toward the sidewalls and not toward the openings of the dish machine 50.

Depending upon the size of the oversized container 100, the stanchion angle and height may be adjusted so that containers of varying depth and width may be racked while maintaining an angle suitable for deflecting spray away toward the sidewalls 52 of the dish machine 50 and not toward the openings of the dish machine 50. The wire frame 150 may also include two or more stanchions such as illustrated in FIG. 4C. For example, the wire frame 150 may include stanchions 154, 156 and 158. In this embodiment, small or oversized containers, such as a hotel pan, may be racked two at a time as shown. In this configuration, sidewall edges 110 of respective containers are angled so that the base 102 of the containers directs spray toward opposing walls 52 of the dish machine 50 and not toward the openings through which the rack and containers are inserted and removed from the dish machine 50. One of the sidewall edges 110 of the container is received within notches 18 while the other sidewall edge is suspended by support of the stanchion 154 and 158 on the underside of the container 100. This configuration also permits the rack 10 to accommodate various containers of varying depth and width while maintaining the surfaces of both containers at angles that deflect spray from the spray arm 62 toward the sidewalls 52 of the dish machine 50 and not at openings of the dish machine 50. Furthermore, the stanchion 156 may be used to support two containers of varying size on the rack 10 at the same time. For example, one container may be supported by stanchion 156 and opposing notches 18 in sidewall 16, while the other container is supported by stanchion 158 and opposing notches 20 in opposing sidewalls 16. Furthermore, the containers are positioned, as previously addressed above, to not deflect spray toward the opening(s) to inhibit spray from passing out of the dish machine 50, which would otherwise increase the time required to run subsequent loads through the dish machine 50 and decrease the efficiency of the dish machine 50 upon each subsequent loss of liquid and required reheating of the replenished liquid.

The above specification, examples, and information provide a description of the manufacture and use of the compositions of the invention. Since many embodiments of the invention can be made without departing from the spirit and scope of the invention, the invention resides in the claims hereinafter appended.

What is claimed is:

1. A dish rack for accommodating an oversized container, the oversized container having a width and a length greater than the width, in an automated dish machine, the dish rack comprising:

a generally porous base surrounded by substantially non-porous upstanding sidewalls, wherein an opposing two of the upstanding sidewalls of the base are separated by a distance less than the length of the oversized container;

a first pair of notches and a second pair of notches in the opposing two of the upstanding sidewalls and each configured to receive a sidewall edge of the oversized container, wherein each of the notches comprises an outside edge, an inside edge, and a bottom edge extending between the outside edge and the inside edge;

wherein the bottom edge of each of the first pair of notches or the second pair of notches is substantially coplanar with the base;

wherein the first pair of notches is in opposite orientation to the second pair of notches, wherein the inside edges of each of the first pair of notches and the second pair of notches are substantially vertical, and the outside edges of each of the first pair of notches and the second pair of notches are substantially angled and configured to pinch the sidewall edges of the oversized container to prevent movement of the oversized container relative to the rack.

2. The dish rack of claim 1 further comprising a wire frame removably placeable on the base, the wire frame having a base and one or more stanchions extending generally upwardly from the base of the wire frame.

3. A dish rack system for use with an automated dish machine, the system comprising:

an oversized container having a width and a length, each of the width and length defined between opposing sidewall edges of the oversized container;

a dish rack comprising:

(a) a generally porous base surrounded by upstanding sidewalls, wherein an opposing two of the upstanding sidewalls are separated from one another by a distance which is less than the length of the oversized container;

(b) a first pair of notches in the two opposing sidewalls of the upstanding sidewalls, and a second pair of notches in the same opposing sidewalls as the first pair of notches; and wherein one of the opposing sidewall edges associated with the length of the oversized container is disposed within the first pair of notches, and further wherein another one of the opposing sidewall edges associated with the length of the oversized container is disposed within the second pair of notches; and wherein the first pair of notches is in opposite orientation to the second pair of notches, wherein the inside edges of each of the first pair of notches and the second pair of notches are substantially vertical, and the outside edges of each of the first pair of notches and the second pair of notches are substantially angled and configured to pinch the sidewall edges of the oversized container to prevent movement of the oversized container relative to the rack.

4. The system of claim 3 wherein a portion of each of the one of the opposing sidewall edges associated with the length of the oversized container and the other one of the opposing sidewall edges associated with the length of the oversized container extend beyond the upstanding sidewalls of the dish rack.

5. The system of claim 3 wherein two remaining opposing sidewalls of the upstanding sidewalls of the dish rack do not have notches.

6. The system of claim 3 further comprising a wire frame removably placeable on the base, the wire frame having a base and one or more stanchions extending generally upwardly from the base of the wire frame.

* * * * *